US008240519B2

(12) United States Patent
Buchstab et al.

(10) Patent No.: US 8,240,519 B2
(45) Date of Patent: Aug. 14, 2012

(54) ICE DISPENSER

(75) Inventors: Martin Buchstab, Bopfingen (DE); Irene Dumkow, Sontheim (DE); Adolf Feinauer, Giengen (DE); Klaus Flinner, Zöschingen (DE); Bernd Heger, Haunsheim (DE); Helen Lewis, Worcestershire (GB); Peter Nalbach, Kirchheim/Nabern (DE); Craig Duncan Webster, Cambridgeshire (GB); Nathan Wrench, Cambridge (GB); Kasim Yazan, Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 625 days.

(21) Appl. No.: 12/310,759

(22) PCT Filed: Aug. 22, 2007

(86) PCT No.: PCT/EP2007/058723

§ 371 (c)(1),
(2), (4) Date: Sep. 28, 2009

(87) PCT Pub. No.: WO2008/028806

PCT Pub. Date: Mar. 13, 2008

(65) Prior Publication Data

US 2010/0025434 A1 Feb. 4, 2010

(30) Foreign Application Priority Data

Sep. 7, 2006 (DE) ..... 20 2006 013 709 U
Dec. 22, 2006 (DE) ..... 10 2006 061 094

(51) Int. Cl.
*G01F 11/20* (2006.01)

(52) U.S. Cl. ..... 222/240; 222/146.6; 222/333; 222/410; 62/320; 62/344

(58) Field of Classification Search ..... 222/235–242, 222/146.6, 412–413, 410, 333; 62/342–344, 62/320, 266; 241/190
See application file for complete search history.

(56) References Cited

U.S. PATENT DOCUMENTS

| | | | | |
|---|---|---|---|---|
| 4,176,527 | A | 12/1979 | Linstromberg et al. | |
| 4,619,380 | A * | 10/1986 | Brooks | 222/240 |
| 4,627,556 | A * | 12/1986 | Brooks | 222/240 |
| 4,846,381 | A | 7/1989 | Kito et al. | |
| 4,972,999 | A * | 11/1990 | Grace | 241/30 |
| 5,056,688 | A * | 10/1991 | Goetz et al. | 222/146.6 |
| 5,104,007 | A * | 4/1992 | Utter | 222/146.6 |
| 5,273,219 | A * | 12/1993 | Beach et al. | 241/65 |
| 6,109,476 | A * | 8/2000 | Thompson et al. | 222/1 |
| 6,973,802 | B1 * | 12/2005 | Seo et al. | 62/320 |
| 2009/0320511 | A1 * | 12/2009 | Buchstab et al. | 62/320 |

* cited by examiner

*Primary Examiner* — Frederick C Nicolas
(74) *Attorney, Agent, or Firm* — James E. Howard; Andre Pallapies

(57) ABSTRACT

An ice dispenser including an ice supply container; a shaft extending into the supply container; a stirrer rotatable about the shaft which extends into the supply container, the stirrer being connectable to a rotation drive device that rotates the stirrer; an output chamber communicated with the supply container, the output chamber having an ice outlet opening; a slider rotatable in the output chamber, a rotation of the slider in a predetermined manner operating to bring the slider into moving engagement with ice located in the output chamber; and a coupling selectively disposable between an active coupling disposition in which the coupling operatively interconnects the stirrer and the slider to one another such that the slider rotates in correspondence with a rotation of the stirrer and a decoupling disposition in which the coupling does not operatively interconnect the stirrer and the slider to one another.

13 Claims, 5 Drawing Sheets

ICE DISPENSER

BACKGROUND OF THE INVENTION

The present invention relates to an ice dispenser, especially an ice dispenser of the type able to be used in a refrigerator to store pieces of ice made by an automatic ice maker of the refrigerator and dispense them as required by a user.

An ice dispenser known from U.S. Pat. No. 4,176,527 A comprises a storage container for pieces of ice, a stirrer able to rotate around an axis extending through the supply container, an output chamber which lengthens the supply container in the direction of the axis and a rotatable slide coupled to the supply container in the output chamber in the form of a number of blades attached in parallel to the axis which, as they rotate, convey the ice penetrating into the output chamber to a outlet opening. The stirrer is embodied over a part of its length as a spiral and over the other part of its length adjacent to the output chamber as a worm drive conveyor, so that pieces of ice are conveyed into the output chamber by the rotation of the stirrer. Were the stirrer to be rotated without ice being able to be dispensed from the output chamber, the ice would build up in the output chamber and block its rotation. A rotation of the stirrer without simultaneous output of ice is thus not possible. If no ice is removed for a long period there is the danger of the pieces of ice freezing solid to each other in the supply chamber and blocking the rotation, so that the ice dispenser must be taken out of the refrigerator and defrosted to allow it to be used again.

To counter this danger, a very powerful drive motor can be provided for the stirrer, and supply container and stirrer can be designed to withstand high mechanical stresses, in order to make it possible to break away the pieces of ice even after long periods without use. In this way, although the danger of blocking of the ice dispenser can be reduced or the period of non-use until a blockage occurs can be extended, this approach is associated with significant costs and there is the danger of pieces of ice being inadvertently crushed in the supply container. However the greater the proportion of small fragments of ice in the supply container, the greater is its tendency to freeze solid and the greater is also the force necessary to release the ice.

U.S. Pat. No. 4,846,381 proposes solving the problem of freezing up by having a separate stirrer and screw conveyor accommodated in the supply container of an ice dispenser and having them driven by a separate motor respectively. This means that the stirrer can be driven to release the pieces of ice from one another without ice being simultaneously output by the screw conveyor. A problem of this construction is the large amount of space required for the stirrer and the separate screw conveyor and its drive motor, which essentially makes this solution of interest for commercial devices used exclusively for ice making.

BRIEF SUMMARY OF THE INVENTION

The object of the present invention is to create an ice dispenser which reliably prevents the freezing solid of stored pieces of ice and which, in doing so, has a structure that can be implemented cost-effectively, which makes it especially suitable for use in a household refrigerator.

The object is achieved in that, with an ice dispenser with a supply container for pieces of ice, a stirrer able to be rotated around an axis extending through the supply container, an output chamber adjoining the supply container and a rotatable slide coupled in the output chamber to the stirrer, with on a wall of the output chamber in which the slide is moved along as it rotates, an outlet opening is formed for ice conveyed by the slide, a coupling is arranged between stirrer and slide in order to optionally transmit or not transmit a drive torque exerted on the slide. If the drive torque is transmitted, the slide rotates together with the stirrer, and pieces of ice which reach the output chamber by the movement of the stirrer or arrive in the output chamber in another way, are conveyed by the slide to the outlet opening. If the drive torque is not transmitted, the slide remains at rest, so that ice is not conveyed to the outlet opening. In this state it is possible to actuate the stirrer on its own in order to release pieces of ice that have frozen together in the supply container, without ice being output simultaneously.

On account of its simple construction, an ice dispenser is preferred in which the stirrer and the slide have the same axis of rotation.

The output chamber expediently has the shape of a cylinder concentric to the axis of rotation of the slide, where the outlet opening is formed in a drum surface of the cylinder.

According to a first embodiment one face side of the cylindrical output chamber is open to the supply container.

According to a second embodiment a dividing wall with a through-opening is arranged between the supply container and the output chamber. The size of the through-opening can be suitably selected to control the rate at which pieces of ice enter the output chamber from the supply container when the stirrer is moved.

The prevent pieces of ice entering the output chamber if the stirrer is just moved to keep the pieces of ice in motion, the slide can advantageously be fixed in a setting blocking the through-opening.

To promote the movement of the pieces of ice from the supply container into the output chamber, the supply chamber preferably has a floor sloping down towards the output chamber.

It is further preferable for the slide to have a first set of fingers and for a second set of fingers to be provided in the output chamber with at least one of the sets comprising at least two axially spaced fingers, and that, with a rotation of the slide, a finger of the other set fits into a space between the two fingers of the one set. Pieces of ice coming between the two sets of fingers are crushed between the fingers and thus reach the outlet opening in the form of small fragments. To improve the crushing effect, the fingers are expediently embodied as blades, with sharp cutting edges.

To safely exclude the output of pieces of ice during stirring when the coupling is open—especially with the above-mentioned first embodiment without dividing wall between supply container and output chamber—the second set of fingers is preferably able to be fixed in a setting bridging the outlet opening.

To prevent the output of the pieces of ice, it is not necessary for the second set of fingers to completely close off the output opening; it is sufficient for it to reduce the free cross section enough for no complete piece of ice to pass through.

If the second set of fingers, in the setting of the fingers bridging the outlet opening, only partly closes off this opening, it can be used in this setting to crush the pieces of ice, since the crushed pieces thus produced can continue to pass through the outlet opening.

In order to also be able to output intact pieces of ice, the second set of fingers is expediently able to be moved between the setting bridging the outlet opening and a setting releasing the outlet opening.

To make it possible for the second set of fingers to return to the bridging setting, without having to provide separate drive means for this purpose, it is advantageous for the bridging setting to be a stable equilibrium setting of the second set of the fingers.

The second set of fingers is preferably locked if required by a user in the output chamber or is able to be rotated jointly with the slide around its axis of rotation.

Such a rotation can be driven in a simple way, if the second set of fingers is positively coupled to the slide.

BRIEF DESCRIPTION OF THE DRAWING

Further features and advantages of the invention emerge from the description of exemplary embodiments given below which refer to the enclosed figures. The figures are as follows.

DETAILED DESCRIPTION OF THE PRESENT INVENTION

Figure 1:
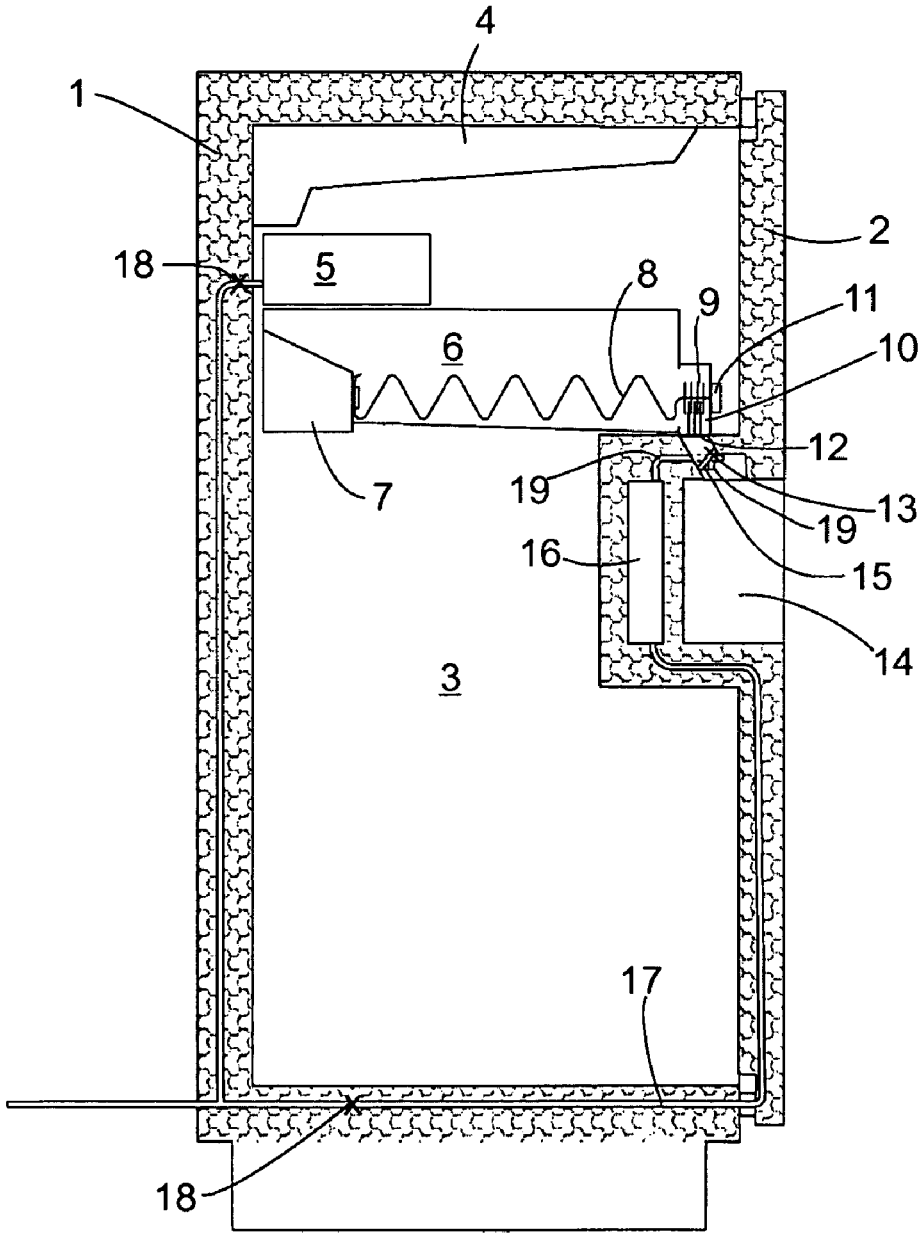
FIG. 1 a schematic section through a domestic refrigerator, which is equipped with an inventive ice dispenser.

The refrigerator shown in FIG. 1 in a schematic section has a heat-insulating chassis 1 and a door 2 which delimits an inner chamber 3. The interior 3 is held at a temperature of below 0° C. by an evaporator, which is accommodated in an evaporator compartment 4 divided off in the upper area of the carcass 1. An automatic ice maker 5 is arranged in the immediate vicinity of the evaporator chamber 4 in the interior 3, so that cold air from the evaporator chamber 4 can preferably be applied to it. The ice maker 5 comprises a number of molding containers known per se, not shown in detail in the figure, means for automatically supplying water into the molding containers, as well as means for automatically discharging from the molding containers the pieces of ice produced.

Arranged below the ice maker 5 is a collection vessel 6 of an ice dispenser which receives the discharged pieces of ice. The collection vessel 6 extends over a large part of the depth of the inner chamber 3. Accommodated in a rear recess 7 of the collection vessel 6 is an electric motor for driving a stirrer 8 extending in a longitudinal direction of the collection vessel 6. At an end 7 of the stirrer 8 extending away from recess rotating blades 9 of a crusher are coupled in a way not described in any greater detail below. The blades 9 are accommodated in a cylindrical output chamber 10, which is open to the collection vessel 6 and lengthens this along the axis of rotation of the stirrer 8. Arranged on an end face of the output chamber 10 facing the door 2 is an electromagnet 11, the function of which is likewise explained further on in this document.

The stirrer 8 is a metal rod bent into a zigzag form in a plane parallel to the axis. Because of its planar shape, unlike a helix or a worm drive, it does not exert any conveying force in an axial direction on the pieces of ice contained in the collection vessel 6, but moves these in random directions and thus prevents them freezing solid to each other over a wide area. Thus the stirrer 8 can be turned from time to time by the motor, without thus pushing pieces of ice into the output chamber 10 and being able to block the latter.

Figure 3:
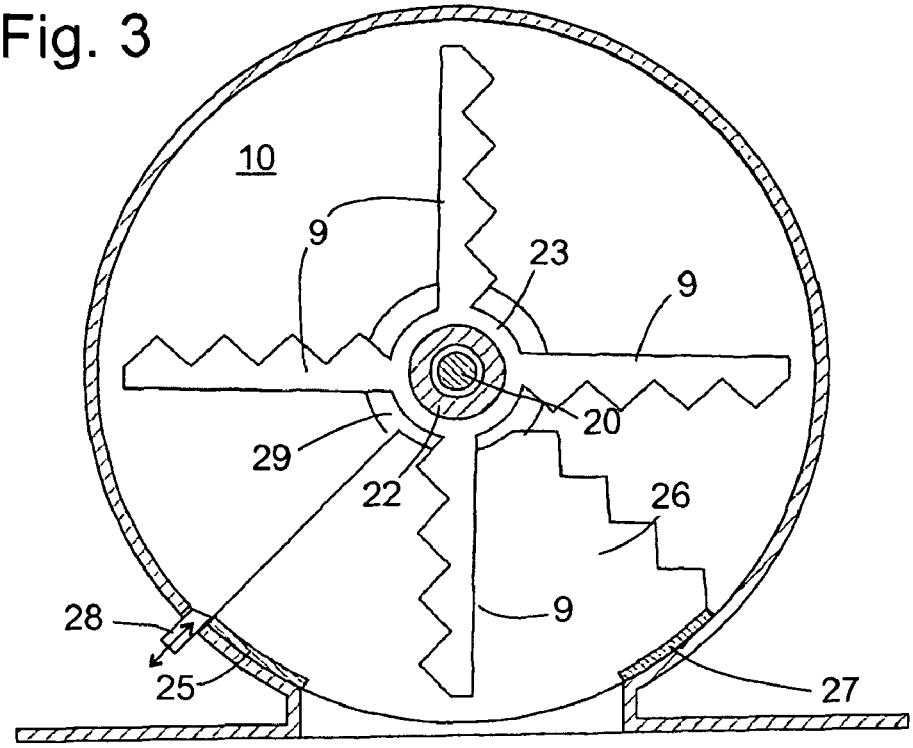
FIG. 3 a schematic section through the output chamber of the ice dispenser of FIG. 2 perpendicular to the axis in an idle operating mode or in an operating mode for output of crushed ice.
Figure 4:
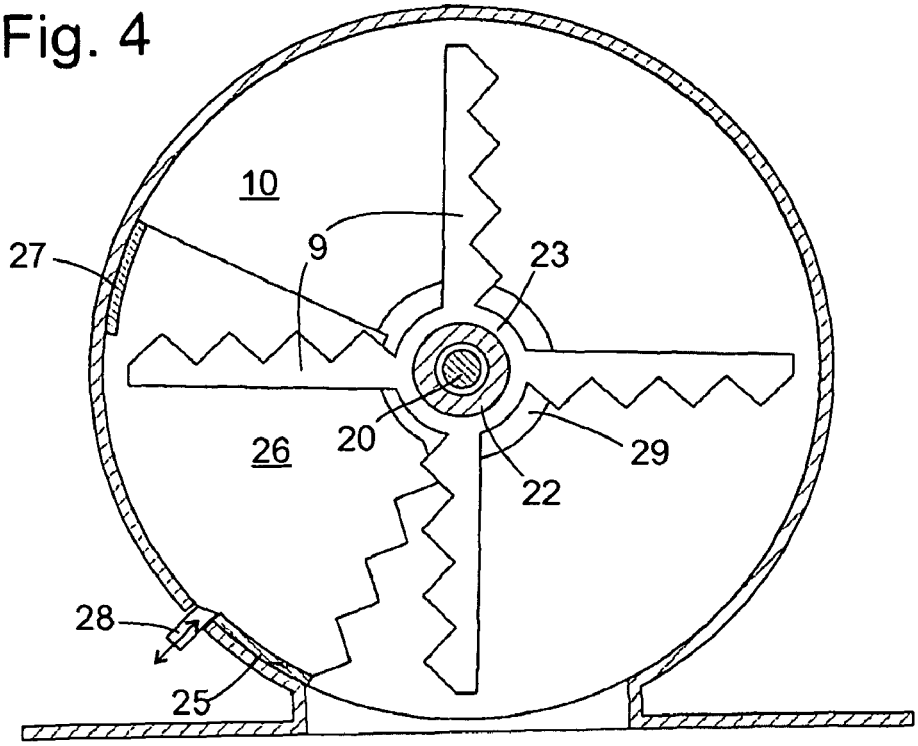
FIG. 4 a section similar to FIG. 3 through the output chamber of the ice dispenser of FIG. 2 in an operating mode for output of pieces of ice.

As can especially be seen in the FIGS. 3, 4, the output chamber 10 has essentially the shape of a horizontal cylinder, on the lateral surface of which is formed an output opening 12 open to the bottom. This outlet opening 12 lies opposite a passage 13 shown in FIG. 1, which extends through the layer of insulation material of the door 2 and comes out into the recess 14 open to the outer side of the door 2. A flap 15 keeps the passage 13 closed while the ice dispenser is in operation in order to dispense ice through outlet opening 12 and the passage 13 into a container placed in the recess 14.

A water tank 16 is embedded on the rear wall of the recess 14 in the insulating material of the door 2. The water tank 16 is connected on the one hand like the ice maker 5 via a supply line 17 and a cut-off valve 18 to the drinking water network and on the other hand to a dispensing nozzle 19 in the recess 14.

Figure 2:
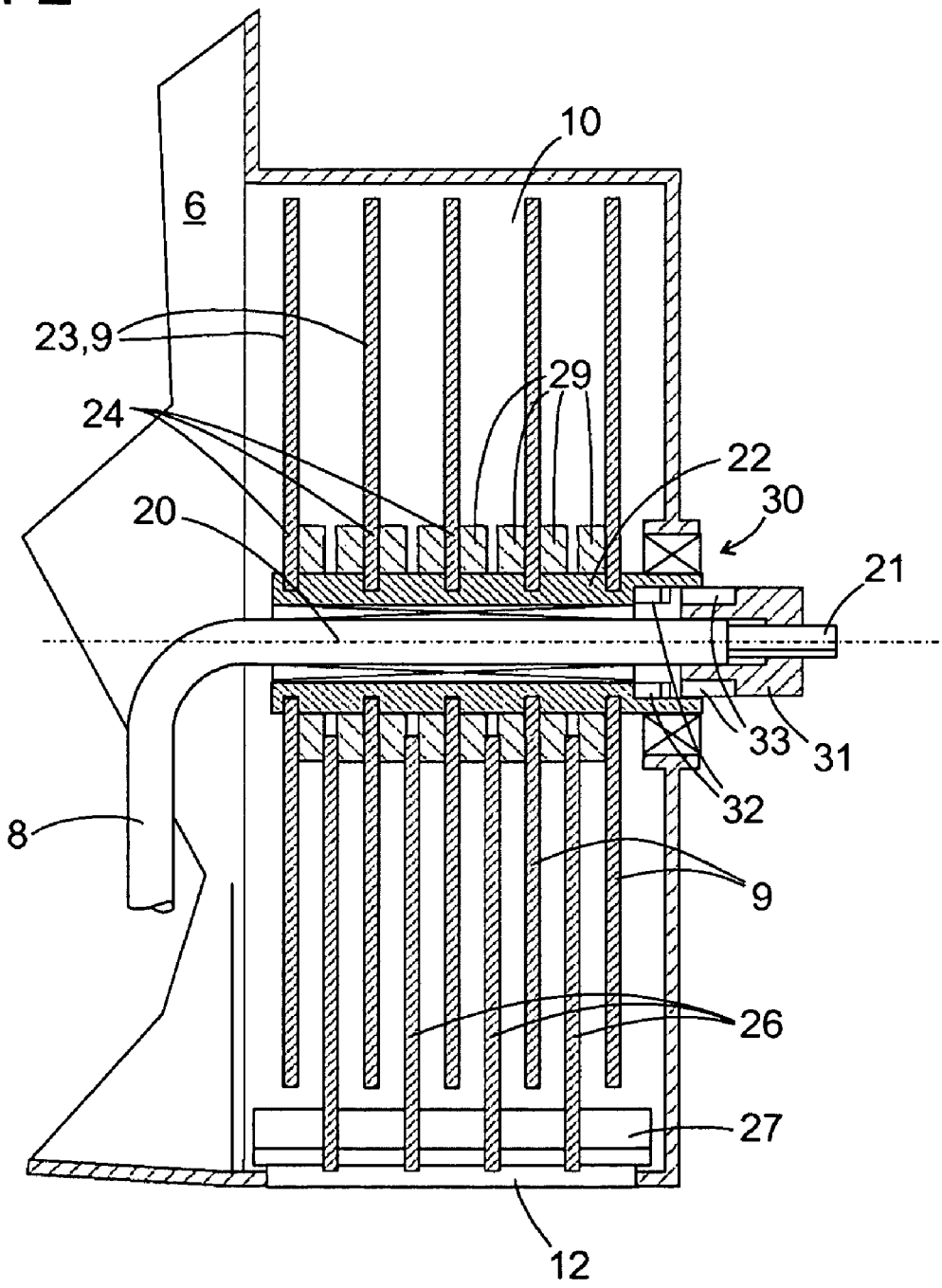
FIG. 2 an enlarged axial section through the output chamber of the ice dispenser in accordance with a first embodiment.

The structure and function of the crusher in accordance with a first embodiment are now described with reference to FIGS. 2 to 4. As can be seen in FIG. 2, the stirrer 8 turns in one piece at its end facing away from the recess 7 into a cylindrical shaft 20 which extends through the output chamber 10. A distal end section 21 of the shaft 20 has a non-round, for example square, cross section. A sleeve 22 easily able to be turned on the shaft 20 supports a plurality of cutting disks 23, of which each, as shown in FIG. 3, bears four blades 9 projecting radially from the core area 24 and which act as slides for pieces of ice located in the output chamber 10. Sharp-edged plates 26 in an approximately quadrant shape engage in the spaces between each two of the slides 23. Edges of the blades 9 and the plates 26 facing towards each other are serrated to enable them to exert a high pressure at some points in order to break up the pieces of ice.

The plates 26 are connected rigidly at their outer circumference by two transverse bars 25, 27. In the configuration shown in FIG. 3 the two transverse bars 25, 27 lie on each side of the outlet opening 12 against the wall of the output chamber 10, while the plates 26 bridge the outlet opening 12. The space between the parallel plates 26 is smaller than the dimensions of the pieces of ice, so that pieces of ice located in the output chamber 10 cannot easily get through between the plates 26 to the outlet opening 12.

The edge sections of the plates 26 adjoining the shaft 20 are respectively clamped via elastic buffer rings 29 between two slides 23, so that the plates 26 tend to follow a rotation of the blades 9 in the counterclockwise direction if they are not prevented from doing so, as shown in FIG. 3 by a stop 28 against the transverse bars 25, 27.

It can again be seen with reference to FIG. 2 that the sleeve 22 is supported to allow it to rotate in a support opening 30 formed in the front face of the output chamber 19 facing towards the door 2. A coupling element 31 is pushed onto the non-round end section 21 of the shaft 20 and with the aid of the electromagnet 11 (not shown in FIG. 2) between the setting shown in FIG. 2, in which the sleeve 22 carrying the blades 9 and the shaft 20 are able to be freely rotated in relation to each other, is able to be moved into a coupling position, in which coupling claws 32 of the sleeve 22 engage into cutouts 33 of the coupling element 31, which established a positive and non-positive fit between the shaft 20 and the sleeve 22.

The ice dispenser functions as follows: While the shaft 20 and the sleeve 22 are not coupled to one another, as shown in FIG. 2, the motor in the recess 7 is activated briefly at predetermined intervals in order to break apart pieces of ice freezing together in the collection vessel and keep them moving. In the view shown in FIG. 3 the motor preferably rotates in the counterclockwise direction in this case. A friction torque transmitted via the bearing of the shaft 20 to the sleeve 22 does not cause the blades 9 to start rotating, since these are braked by the plates 26 clamped to the buffer rings 29 and blocked by the stop 28. Pieces of ice which are located in the output chamber 10 do not reach the outlet opening 12 since they cannot get past the plates 26.

If the coupling element 31 is moved, to establish the positive connection between shaft 20 and sleeve 22 the blades 9 rotate jointly with the stirrer 8 in the counterclockwise direction. Pieces of ice which reach the output chamber 10 are pushed by the rotating blades 9 against the plate 26 and crushed between the rotating blades 9 and the plates 26 blocked by the stop 28. The fragments produced in such cases pass through the spaces between the plates 26 and reach the outlet opening 12. Crushed ice is thus dispensed.

To dispense ice in pieces it is sufficient to withdraw the stop 28 briefly while the stirrer 8 is rotating in the counterclockwise direction. Because of the clamping between the buffer rings 29 the plate 26 rotates together with the blades 9 and releases the outlet opening 12, so that the blades 9 push intact pieces of ice to the outlet opening 12 and these are output.

Basically it is possible to leave the stop 28 withdrawn while the pieces of ice are being output, so that the plates 26 perform the same rotation as the blades 9. In this case however it is difficult to measure out the pieces of ice since the dispensing mode for pieces of ice can only be ended if the plates 26 have reached the setting shown in FIG. 3 again and are locked by the stop 28 in this setting. According to a preferred variant, during the transition to the mode in which pieces of ice are output, the stop 28 is thus only kept withdrawn for as long as is required so that the leading one of the two transverse bars 27 in the direction of rotation can pass the stop 28. If subsequently the stop 28 moves back into the output chamber 10 it blocks, as shown in FIG. 4, the transverse bars 25 following in the direction of rotation in a setting, in which the outlet opening 12 is completely free. To end the mode for dispensing pieces of ice it is sufficient to withdraw the coupling element 31 from the sleeve 22 again, so that the engagement between the coupling claws 32 and the cutouts 33 is lost. The arrangement of sleeve 22, blades 9, plates 26 and bars 25, 27 now able to again be rotated freely against the shaft 20 returns, driven by the weight of the plate 26 and the bars, 25, 27, automatically to a stable position of equilibrium corresponding to the position shown in FIG. 3, in which it is again blocked by the stop 28.

Figure 5:
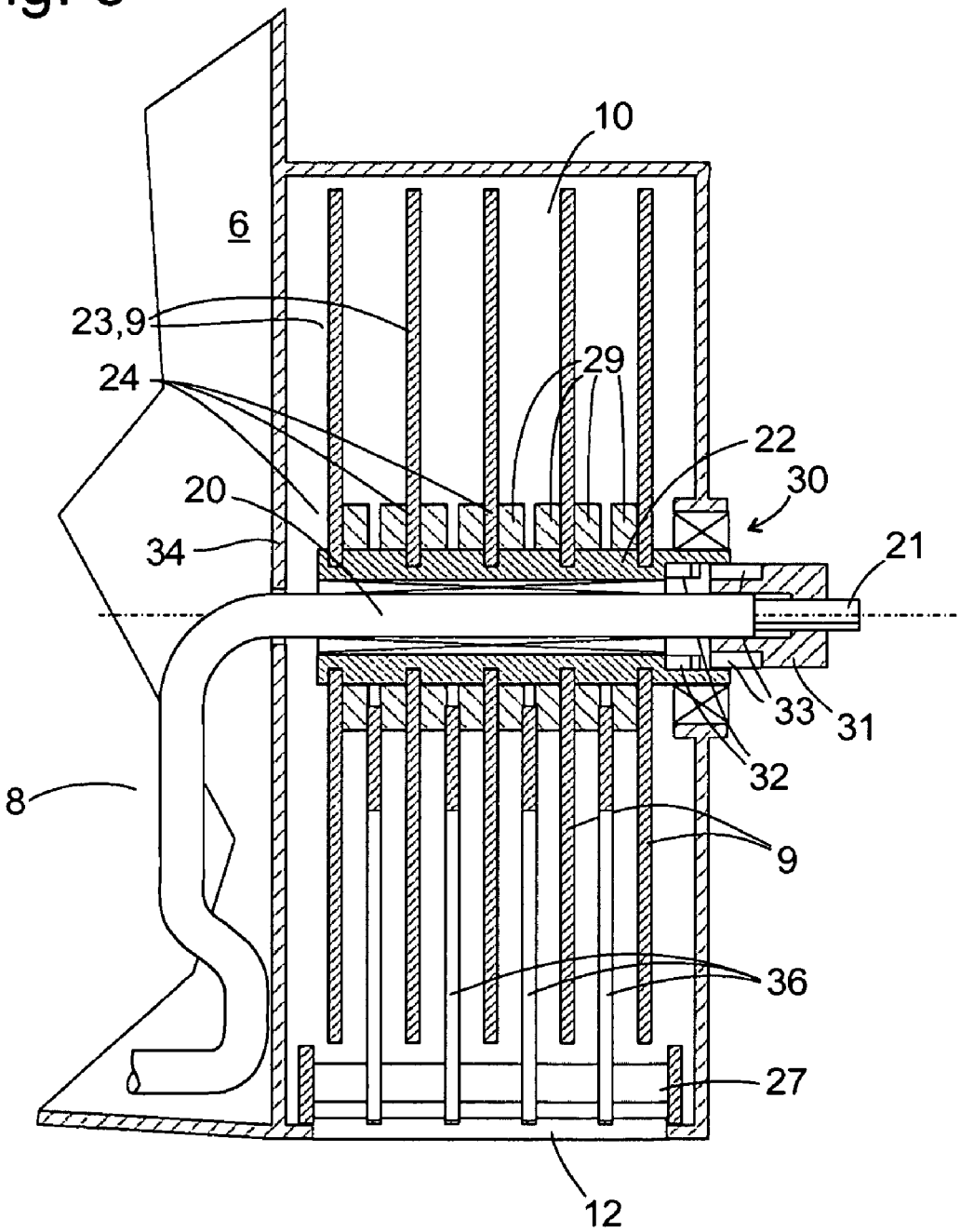
FIG. 5 an enlarged axial section through the output chamber of the ice dispenser in accordance with a second embodiment.
Figure 6:
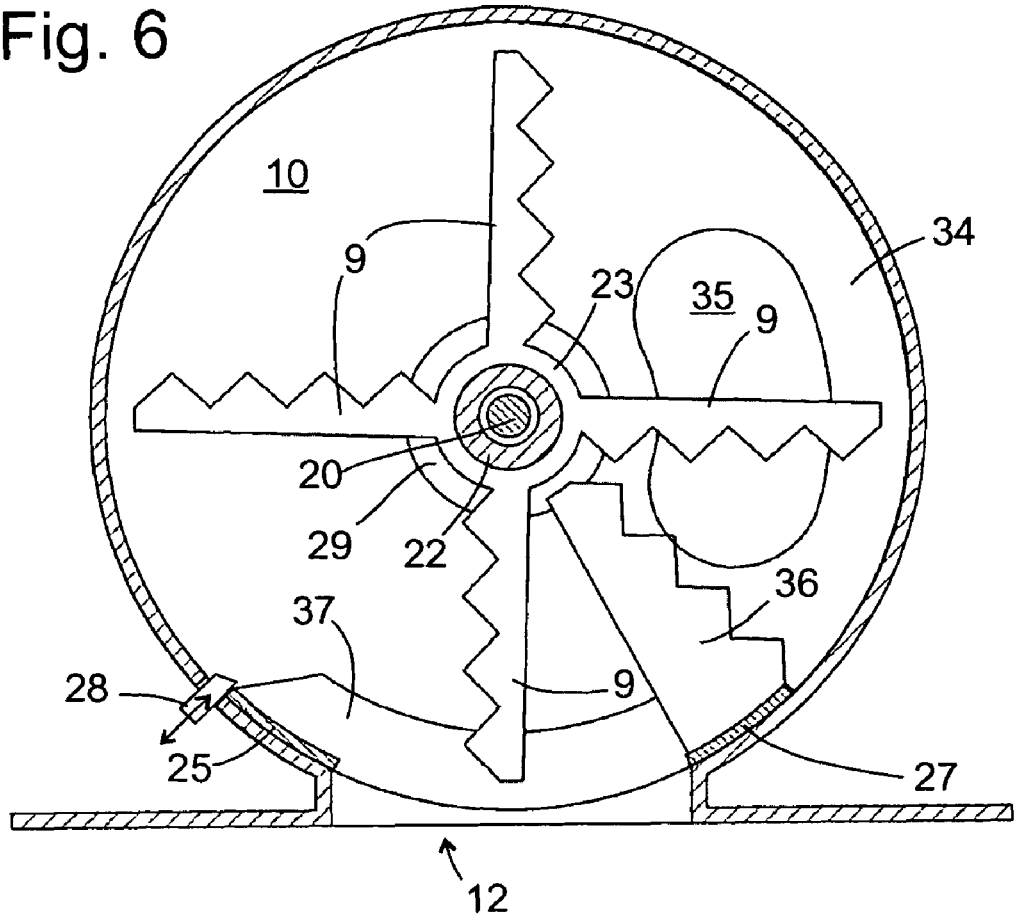
FIG. 6 a schematic section through the output chamber of the ice dispenser of FIG. 5 perpendicular to the axis.

FIGS. 5 and 6 show the output chamber of an ice dispenser in accordance with a second embodiment of an invention in an axial section, or a section perpendicular to the axis. Elements of this ice dispenser which correspond to elements already explained in relation to the first embodiment of FIG. 2 to 4 are provided with the same reference symbols and are not explained once again.

In this embodiment the shaft 20 extends through a partition wall 34 which separates the collection vessel 6 and the output chamber 10 from each other. A through-opening 35 (see FIG. 6) in the partition wall 34 enables the transfer of pieces of ice from the collection vessel 6 into the output chamber 10 when the stirrer 8 is rotating. The stirrer 8 wipes along the partition wall 34 close to the floor of the collection vessel 6 extending away from the partition wall 34, so with a low fill level of the collection vessel 6, pieces of ice are reliably caught and lifted through the through-opening 35, so that they can fall through said opening into the output chamber 10.

The blades 9 able to be coupled in the output chamber 10 with the aid of the electromagnet 11 to the rotation of the stirrer 8 have the same shape as shown in FIGS. 3 and 4. The wide plates 26 on the other hand are replaced by blades 36, the width of which does not differ significantly from that of the rotating blades 9. They extend respectively from one of the two transverse bars 27 and are clamped by their tips to allow movement between elastic buffer rings 29 rotating with the blades 9. To stabilize the blades 36 in their setting shown in FIG. 6 the two transverse bars 25, 27 are connected through the partition wall 34 or by an arch 37 adjacent to a front wall of the output chamber 10.

In the configuration shown in FIG. 6 the blades 36 are latched by the stop 28 and pieces of ice which pass through the through-opening 35 are crushed between the blades 9, 36 before they reach the outlet opening 12.

If intact pieces of ice are to be delivered it is sufficient to withdraw the stop 28, so that as a result of the clamping of the blades 36 between the buffer rings 29, the blades 36 are carried along with the rotation of blades 9. There can be provision for the stop 28 to be withdrawn precisely when a group of blades 9 passes the blades 36. In this way an even delivery of the pieces of ice can be achieved since the blades 36 do not prevent the pieces of ice getting through the through-opening 35 in one of the spaces between the four groups of blades 9.

If the coupling element 31 is disengaged to make it possible to rotate the stirrer 8 without simultaneously rotating the sleeve 22 and the blades 9, this expediently occurs if the blades 9 are in an orientation as shown in FIG. 6, in which a group of blades 9 is crossing the through-opening 35. Thus the blades 9 prevent an uncontrolled transfer of pieces of ice into the output chamber 10, which would otherwise lead, depending on the setting of the blades 36 to pieces of ice being delivered in an uncontrolled manner via the outlet opening 12 or collecting in front of the blades 36.

The invention claimed is:

1. An ice dispenser comprising:

a supply container defining a volume in which pieces of ice are retained;

a shaft extending into the volume defined by the supply container;

a stirrer rotatable about the shaft which extends through the supply container, the stirrer being connectable to a rotation drive device that rotates the stirrer;

an output chamber communicated with the supply container, the output chamber having an outlet opening via which the ice in the output container can exit from the output chamber;

a slider rotatable in the output chamber, a rotation of the slider in a predetermined manner operating to bring the slider into moving engagement with the ice located in the output chamber; and a coupling selectively disposable between an active coupling disposition in which the coupling operatively interconnects the stirrer and the slider to one another such that the slider rotates in correspondence with a rotation of the stirrer and a decoupling disposition in which the coupling does not operatively interconnect the stirrer and the slider to one another for corresponding rotation of the slider in correspondence with a rotation of the stirrer.

2. The ice dispenser according to claim 1 wherein the stirrer and the slider have a common axis of rotation.

3. The ice dispenser according to claim 1 wherein the output chamber is formed as a cylinder concentric with the axis of rotation of the slider and wherein the outlet opening is formed on a lateral surface of the cylinder.

4. The ice dispenser according to claim 3 wherein a face side of the cylindrical output chamber is open to the supply container.

5. The ice dispenser according to claim 1 and further comprising a dividing wall disposed between the supply container and the output chamber, wherein the dividing wall is formed with a through-opening.

6. The ice dispenser according to claim 5 wherein the slider is configured for being fixed in a position blocking off the through-opening.

7. The ice dispenser according to claim 1 wherein the supply container has a floor sloping downwardly toward the output chamber.

8. The ice dispenser according to claim 1 wherein the slider includes a first set of fingers and wherein a second set of fingers is supplied in the output chamber, with at least one of said first set of fingers and said second set of fingers including at least two axially spaced fingers, and that for a rotation of the slider, a finger of each respective set fits into a space between two fingers of the other respective set.

9. The ice dispenser according to claim 8 wherein the second set of fingers is configured for being fixed in a disposition bridging the outlet opening.

10. The ice dispenser according to claim 9 wherein the second set of fingers is configured for movement between the setting bridging the outlet opening and a setting releasing the outlet opening.

11. The ice dispenser according to claim 9 wherein the setting bridging the outlet opening is a stable equilibrium setting of the second set of fingers.

12. The ice dispenser according to claim 8 wherein the second set of fingers is configured for selectively being latched in the outlet chamber or to be turned jointly with the slider about its axis of rotation.

13. The ice dispenser according to claim 12 wherein the second set of fingers is coupled positively to the slider so as to be carried along by the rotation of the slider.

* * * * *